US007391145B2

(12) United States Patent
Tatsumi et al.

(10) Patent No.: US 7,391,145 B2
(45) Date of Patent: Jun. 24, 2008

(54) COLD-CATHODE ELECTRON SOURCE, MICROWAVE TUBE USING IT, AND PRODUCTION METHOD THEREOF

(75) Inventors: Natsuo Tatsumi, Itami (JP); Takahiro Imai, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/211,665

(22) Filed: Aug. 26, 2005

(65) Prior Publication Data

US 2006/0001360 A1 Jan. 5, 2006

Related U.S. Application Data

(63) Continuation of application No. PCT/JP2004/004245, filed on Mar. 26, 2004.

(30) Foreign Application Priority Data

Mar. 28, 2003 (JP) ..... 2003-091804

(51) Int. Cl.
*H01J 1/304* (2006.01)

(52) U.S. Cl. ..... 313/311; 313/310; 313/497

(58) Field of Classification Search ..... 313/309, 313/310, 311, 497
See application file for complete search history.

(56) References Cited

U.S. PATENT DOCUMENTS 5,495,143 A * 2/1996 Lengyel et al. ..... 313/574
5,682,078 A * 10/1997 Shishido ..... 313/336
5,844,252 A * 12/1998 Shiomi et al. ..... 257/10
5,929,557 A * 7/1999 Makishima et al. ..... 313/309
6,132,278 A * 10/2000 Kang et al. ..... 445/14
6,201,342 B1 * 3/2001 Hobart et al. ..... 313/309
6,762,543 B1 * 7/2004 Kang et al. ..... 313/311

FOREIGN PATENT DOCUMENTS

JP 6-342633 12/1994
JP 8-17330 1/1996
JP 8-255558 10/1996
JP 8-315721 11/1996

(Continued)

OTHER PUBLICATIONS

Spindt "A Thin-Film Field-Emission Cathode" Journal of Applied Physics vol. 39, p. 3504-3505, Mar. 1991.

(Continued)

*Primary Examiner*—Karabi Guharay
(74) *Attorney, Agent, or Firm*—McDermott Will & Emery LLP

(57) ABSTRACT

A cold-cathode electron source is formed that successfully achieves a high frequency and a high output. Embodiments include a cold-cathode electron source comprising emitters having a tip portion tapered at an aspect ratio R of not less than 4, thereby decreasing capacitance between the emitters and a gate electrode by a degree of declination from the gate electrode, such that the cold-cathode electron source is able to operate at a high frequency. Embodiments also include a cold-cathode electron source formed of a diamond with a high melting point and a high thermal conductivity, such that the emitters operate at a high current density and at a high output.

3 Claims, 10 Drawing Sheets

FOREIGN PATENT DOCUMENTS

| | | |
|---|---|---|
| JP | 09-082248 | 3/1997 |
| JP | 10-92296 | 4/1998 |
| JP | 10-208618 | 8/1998 |
| JP | 2000-188388 | 7/2000 |
| JP | 2000-215788 | 8/2000 |
| JP | 2000-286245 | 10/2000 |
| JP | 2001-23505 | 1/2001 |
| JP | 2001-202871 | 7/2001 |
| JP | 2003-109493 | 4/2003 |

OTHER PUBLICATIONS

McGruer et al., "Prospects for a 1-THz Vacuum Microelectronic Microstrip Amplifier" IEEE Transactions on Electron Devices vol. 38, p. 666-671.

Supplemental European Search Report, Issued in corresponding European Patent Application No. 0472335.9-2208, dated on Jun. 22, 2007.

English translation of Japanese Office Action issued in corresponding Japanese Patent Application No. 2005-504304, dated Mar. 13, 2007.

Japanese Office Action, with English Translation, Issued in Japanese Patent Application No. 2005-504304, dated on Dec. 4, 2007.

Nishibayashi et al. "Various field Emitters of Single Crystal Diamond" New Diamond and Frontier Carbon Technology, vol. 13, No. 1, pp. 19-30, Jan. 29, 2003.

Ando et al. "Fabrication of Diamond Emitter Tips by Reactive Ion Etching", New Diamond and Frontier Carbon Technology, vol. 12, No. 3, pp. 137-140, May 28, 2002.

European Search Report issued in European Patent Application No. EP 04 723 735.9, mailed Feb. 20, 2008.

* cited by examiner 30
24
12

32
24
12

32
24
14
12

16
32
24
14
12

16
20
24
14
12

24
14
12
33
33a
16A
16A (16)

COLD-CATHODE ELECTRON SOURCE, MICROWAVE TUBE USING IT, AND PRODUCTION METHOD THEREOF

REFERENCE TO RELATED APPLICATION

This application is a continuation of International Application No. PCT/JP2004/004245, whose international filing date is Mar. 26, 2004, which in turn claims the benefit of Japanese Application No. 2003-091804, filed Mar. 28, 2003, the disclosures of which Applications are incorporated by reference herein. The benefit of the filing and priority dates of the International and Japanese Applications is respectfully requested.

BACKGROUND OF THE INVENTION

1. Field of the Invention

The present invention relates to a cold-cathode electron source for emitting an electron beam, a microwave tube using it, and a production method thereof.

2. Related Background Art

Conventionally, a microwave tube such as a traveling-wave tube (TWT) or a klystron uses a focusing type hot-cathode electron source or a cold-cathode electron source having microscopic emitters of conical shape, and a cold cathode is disclosed, for example, in Non-patent Document 1 below or other documents. In general, this cold cathode (a cathode electrode and emitters (electron emitting electrodes)) is made up of such a material as a refractory metal material, e.g., tungsten or molybdenum, or a semiconductor material, e.g., silicon.

A commonly known method of constructing this microwave tube so as to support an operation at higher frequencies is to decrease capacitances between a gate electrode for adjusting the amount of electrons emitted from the emitters, and the emitters and between the gate electrode and the cathode electrode. In the cold-cathode electron source 50 disclosed in Non-patent Document 2 below, an insulating layer 52 is thickened to set the gate electrode 54 apart from the cathode electrode 56, thereby decreasing the capacitance between the gate electrode 54 and the cathode electrode 56 (cf. FIG. 9). This cold-cathode electron source 50 adopts the emitter shape in which only a part of the upper end of emitter 58 is tapered and in which the remaining major part is maintained in a thick circular cylinder shape, whereby the current density of an electric current flowing in the emitter 58 is lowered to prevent melting of the emitter 58.

Another example of the reduction of the capacitance between the gate electrode and the cathode electrode and the like is the cold-cathode electron source disclosed in Patent Document 1 below, and in this cold-cathode electron source 60 the insulating layer 64 is thickened stepwise with distance from the emitters 62, thereby decreasing the capacitance between the gate electrode 66 and the emitters 62 and the capacitance between the gate electrode 66 and the cathode electrode 68 (cf. FIG. 10).

[Patent Document 1] Japanese Patent Application Laid-Open No. 9-82248

[Patent Document 2] Japanese Patent Application Laid-Open No. 2001-202871

[Patent Document 3] Japanese Patent Application Laid-Open No. 8-255558

[Non-patent Document 1] Nicol E. McGruer, A Thin-Film Field-Emission Cathode, "Journal of Applied Physics," 39 (1968), p. 3504-3505

[Non-patent Document 2] Nicol E. McGruer, Prospects for a 1-THz Vacuum Microelectronic Microstrip Amplifier, "IEEE Transactions on Electron Devices," 38 (1991), p. 666-671

SUMMARY OF THE INVENTION

However, the conventional cold-cathode electron sources described above had the following problems. Namely, the cold-cathode electron source 50 shown in FIG. 9 achieved the reduction of the capacitance between the cathode electrode 56 and the gate electrode 54, but this cold-cathode electron source 50 was not one fully supporting a high-frequency microwave tube, because nothing was considered about the capacitance between the emitter 58 and the gate electrode 54. It is also known that to increase the current density of the electric current flowing in the emitter is effective for making the microwave tube support a high output power, but the emitters composed of the conventional cathode materials such as tungsten and silicon have low thermal conductivities and reach the heat radiation limit (melting limit) at the current density of about 10-100 A/cm$^2$. Therefore, it was difficult to increase the current density over the mentioned range.

The cathode electrode using diamond is disclosed, for example, in Patent Document 2 above, and the cold cathode of the microwave tube using diamond, for example, in aforementioned Patent Document 3.

The present invention has been accomplished in order to solve the above problems and an object of the invention is to provide a cold-cathode electron source successfully achieving both a high frequency and a high output power, a microwave tube using it, and a production method thereof.

A cold-cathode electron source according to the present invention is a cold-cathode electron source comprising: a flat-plate cathode electrode comprising a diamond and having a plurality of microscopic projecting emitters on a surface; an insulating layer laid around the emitters on the surface of the cathode electrode; and a gate electrode laid on the insulating layer, the cold-cathode electron source being configured to adjust an amount of electrons emitted from the emitters of the cathode electrode to the outside, by controlling a voltage applied to the gate electrode, wherein the emitters have a tapered tip portion of substantially conical shape and wherein an aspect ratio R defined below is not less than 4: R=H/L, where H is a height of the tapered portion and L a diameter of a bottom surface of the tapered portion.

In this cold-cathode electron source, the tip portions of the emitters are so tapered that the aspect ratio R is not less than 4. This aspect ratio R is a ratio of the height H of the tapered portions of the emitters to the diameter L of the bottom surface thereof, and indicates the sharpness of the emitters. Namely, among emitters having the same length, the bottom surface of the tapered portion of each emitter having the aspect ratio of not less than 4 is lower than that of each emitter having the aspect ratio of less than 4. Accordingly, each emitter having the aspect ratio of not less than 4 has a smaller capacitance between the emitter and the gate electrode by the degree of declination from the gate electrode. For this reason, the cold-cathode electron source according to the present invention is able to support an operation at a high frequency. The cathode material of this cold-cathode electron source is none of the conventional cathode materials such as tungsten and silicon, but is the diamond with a high melting point and a high thermal conductivity. For this reason, in the case where the current density of the electric current flowing in the emitters is so high as to generate a considerable amount of heat, the emitters are unlikely to melt, so that this cold-cathode electron source is able to support an operation at a high output.

The insulating layer is preferably comprised of a diamond. In this case, coefficients of thermal expansion of the insulating layer and the cathode electrode are identical or equivalent, which can suppress occurrence of peeling at the interface between the insulating layer and the cathode electrode with temperature change. When a diamond with a high thermal conductivity is adopted for the insulating layer, it can absorb heat released from the emitters and promote cooling of the emitters.

The gate electrode is preferably comprised of a diamond. In this case, coefficients of thermal expansion of the gate electrode and the insulating layer are identical or equivalent, which can suppress occurrence of peeling at the interface between the gate electrode and the insulating layer with temperature change. When a diamond with a high thermal conductivity is adopted for the gate electrode, it can suppress deformation of the gate electrode due to heat. Furthermore, since diamond has a high melting point, it can suppress occurrence of melting of the gate electrode.

Preferably, a density of the emitters on the surface of the cathode electrode is not less than $10^7$ emitters/$cm^2$. In this case, an increase in the density of emitters can lead to an increase in the emission amount of electrons from the cathode electrode.

Preferably, a radius of curvature at the tip of the emitters is not more than 100 nm. In this case, it is feasible to increase the emission efficiency of electrons emitted from the emitters.

It is also preferable in terms of decreasing the capacitance to adopt a configuration wherein the insulating layer and the gate electrode have electron emission holes having a diameter larger than a diameter of the emitters, and wherein each emitter is disposed inside the electron emission hole so as not to contact the insulating layer and the gate electrode. In this case, the emitters are substantially prevented from short-circuiting.

It is also preferable to adopt a configuration wherein the plurality of emitters are formed on the cathode electrode, and wherein with distance of the emitters from a specific point on the cathode electrode, a relative position of each emitter to the corresponding electron emission hole increases its deviation amount toward the specific point. In this case, electrons emitted from the electron emission holes are focused on the specific point by the so-called electrostatic lens effect, so as to increase the current density of the electric current obtained from the cold-cathode electron source.

A microwave tube according to the present invention comprises the foregoing cold-cathode electron source. Since the forgoing cold-cathode electron source is able to support an operation at a high frequency and at a high output, an improvement in frequency and output can be made where this cold-cathode electron source is applied to the microwave tube.

A production method of a cold-cathode electron source according to the present invention is a method of producing a cold-cathode electron source which comprises a flat-plate cathode electrode comprising a diamond and having a plurality of microscopic projecting emitters on a surface; an insulating layer laid around the emitters on the surface of the cathode electrode; and a gate electrode laid on the insulating layer, which is configured to adjust an amount of electrons emitted from the emitters of the cathode electrode to the outside, by controlling a voltage applied to the gate electrode, in which the emitters of the cold-cathode electron source have a tapered tip portion of substantially conical shape, and in which an aspect ratio R defined below is not less than 4: R=H/L, where H is a height of the tapered portion and L a diameter of a bottom surface of the tapered portion; the method comprising: a step of covering entire surfaces of the emitters with a film; a step of depositing the insulating layer around the emitters on the surface of the cathode electrode; a step of depositing the gate electrode on the insulating layer; and a step of removing the film covering the emitters, by etching.

In this production method of the cold-cathode electron source, the emitters having the aspect ratio of not less than 4 are covered with the film and thereafter the insulating layer and the gate electrode are laid around them; therefore, there is no need for accurate locating of the emitters, different from production methods using photolithography. For this reason, the insulating layer and the gate electrode can be laid around the emitters by a simple method.

BRIEF DESCRIPTION OF THE DRAWINGS

The present invention may be more readily described with reference to the accompanying drawings, in which.

DESCRIPTION OF THE PREFERRED EMBODIMENTS

The preferred embodiments of the cold-cathode electron source according to the present invention, the microwave tube using it, and the production method thereof will be described below in detail with reference to the accompanying drawings. Identical or equivalent elements will be denoted by the same reference symbols, without redundant description.

Figure 1:
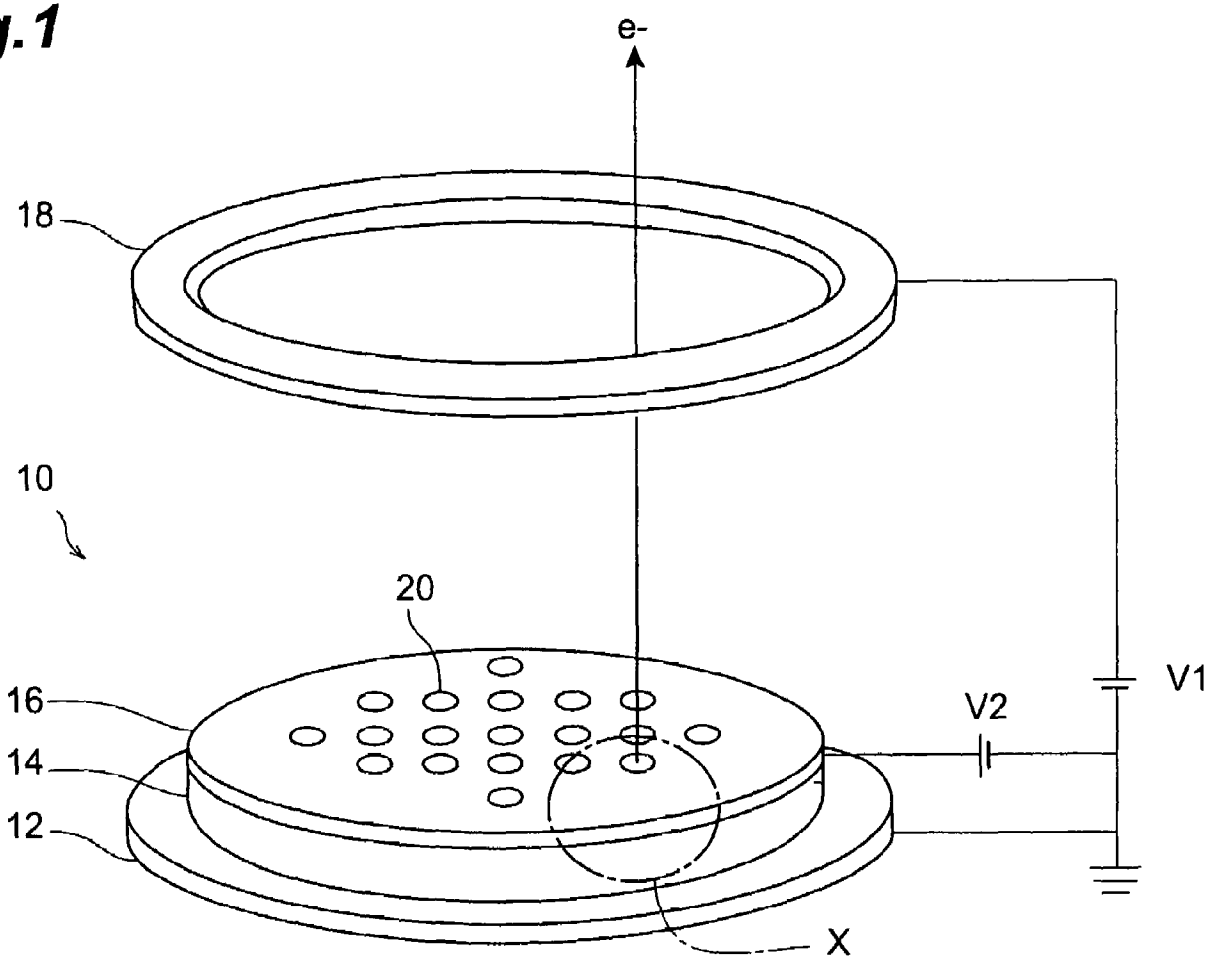
FIG. 1 is a schematic perspective view of a cold-cathode electron source according to an embodiment of the present invention.

FIG. 1 is a schematic configuration diagram of a cold-cathode electron source 10 according to an embodiment of the present invention. This cold-cathode electron source 10 has a cathode electrode 12 of circular flat plate shape, an insulating layer 14 of circular flat plate shape formed on the cathode electrode 12, and a gate electrode 16 of circular flat plate shape formed on this insulating layer 14, and emits electrons toward an annular focusing electrode 18 opposed as spaced by a predetermined distance. Electron emission holes 20 arrayed in a matrix are formed in the insulating layer 14 and the gate electrode 16. Emitters described later are formed at positions corresponding to the electron emission holes 20, on the surface of the cathode electrode 12.

The cathode electrode 12 is electrically connected to the negative pole of an external power supply V1. The gate electrode 16 is electrically connected to an external power supply V2.

In this cold-cathode electron source 10, when electrons are supplied from the external power supply V1 to the cathode electrode 12, the emitters formed on the surface of the cathode electrode 12 emit electrons toward the focusing electrode 18. On this occasion, the voltage applied to the gate electrode 16 is varied by the external power supply V2 to change the electric field around each electron emission hole 20, thereby achieving shutoff of electrons emitted from the electron emission holes 20, and adjustment of emission amount.

The cathode electrode 12 and the gate electrode 16 are made of an electrically conductive diamond and the insulating layer 14 is made of an insulating diamond. Since the cathode electrode 12, gate electrode 16, and insulating layer 14 are made of the like diamond materials as described above, coefficients of thermal expansion of the respective elements 12, 14, and 16 are substantially identical. Therefore, occurrence of peeling is suppressed at the interfaces between the elements 12, 14, and 16 even if the temperature environments of the cold-cathode electron source 10 vary in a wide range.

By adopting the diamond with a high thermal conductivity and a high melting point for the insulating layer 14 and the gate electrode 16, it is feasible to suppress deformation of the gate electrode 16 due to heat and to make each of the insulating layer 14 and the gate electrode 16 absorb heat released from the emitters 24 to promote cooling of the emitters 24. Since the conventional insulating layers were made of silicon dioxide, silicon nitride, or the like, the thermal conductivities thereof were too low to efficiently cool the emitters. In addition, the breakdown voltage of $SiO_2$ used as a material of the conventional insulating layers is from $10^5$ V/cm to at most about $10^7$ V/cm, whereas the breakdown voltage of diamond is as high as $10^7$ V/cm or more; therefore, the insulating layer 14 made of the diamond is unlikely to break down even if the voltage is high between the gate voltage and the cathode voltage.

In cases where a metal material was used as the material of the gate electrode 16, when an abnormal operation such as arc discharge occurred, the molten metal of the gate electrode 16 was scattered in a wide range and attached to the surrounding members to cause a short-circuit between the gate electrode 16 and the cathode electrode 12. In contrast, when the gate electrode 16 is made of the diamond with a high melting point, the gate electrode 16 is unlikely to melt, so as to suppress the occurrence of a short-circuit between the gate electrode 16 and the cathode electrode 12. Furthermore, the diamond has the high melting point and thus suppresses the occurrence of melting of the gate electrode.

For imparting the electrical conductivity to the diamond, the diamond is doped with boron, phosphorus, sulfur, lithium, or the like. Another method of obtaining the electrically conductive diamond is to use a polycrystalline diamond having a graphite component in grain boundaries. The diamond surface may be hydrogen-terminated to form a surface conductive layer. A further method is to effect ion implantation or the like in a diamond to form a graphite component therein, thereby forming a current-passing region. It is noted that the "diamond" stated in the present specification embraces monocrystalline diamonds and polycrystalline diamonds.

Figure 2:
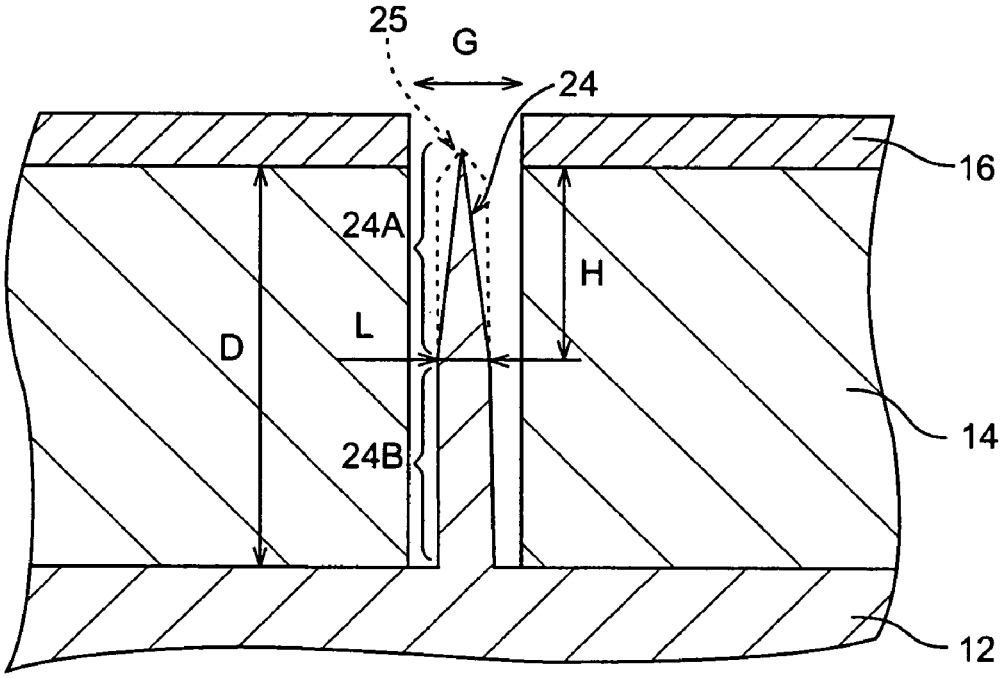
FIG. 2 is an enlarged view of major part (X) of the cold-cathode electron source of FIG. 1.

The emitters of the cathode electrode 12 will be described below. FIG. 2 is an enlarged view of major part (X) of FIG. 1.

As shown in FIG. 2, each emitter 24 formed on the cathode electrode 12 is comprised of a tapered portion 24A of conical shape on the tip side, and a non-tapered portion 24B of cylindrical shape on the fixed end side. This emitter 24 is formed by etching the cathode electrode 12 by a method described later, and is made of an electrically conductive diamond as the cathode electrode is. In a preferred configuration, for example, the length H of the tapered portion 24A is 4 μm, the diameter L of the bottom surface of the tapered portion 24A (a boundary surface between the tapered portion 24A and the non-tapered portion 24B) is 1 μm, and the aspect ratio R (=H/L) obtained by dividing the length H by the diameter L is 4. This aspect ratio R represents a value indicating sharpness of the emitter 24, and the larger this value, the sharper the emitter 24.

In the emitter 24 having the aspect ratio R of 4, when compared with the conventional emitter shape (cf. numeral 25 in the drawing), the conical slope part of the emitter 24 becomes more distant from the gate electrode 16 and thus the capacitance between the emitter 24 and the gate electrode 16 is reduced by that degree. Since the tungsten and silicon being the conventional emitter materials (cathode materials) melt at the current density of the electric current flowing in the emitter in the range of about 10 to 100 A/cm$^2$, it was very difficult to achieve the aspect ratio of the emitter of not less than 4. However, when the diamond with excellent thermal conductivity and chemical stability is used as the material of the emitter, the emitter is unlikely to be damaged even with a high current density of the electric current flowing in the emitter 24 of the cathode electrode 12.

When the emitters 24 and the cathode electrode 12 are made of the diamond, electron emission occurs at a low application voltage. This is because the work function of diamond is low. In this case, the emitters 24 generate a relatively small amount of heat and the consumed power for electron emission is also low.

It is generally known that the electric field established by the cold-cathode electron source 10 charges the electrons in positive around the cold-cathode electron source 10 and the positively charged electrons sputter the emitters 24 to shorten the lifetime of the emitters 24. However, a long life can be implemented by the emitters 24 made of the diamond with high resistance to sputter deterioration.

The total height D of the emitter 24 as combination of the tapered portion 24A and the non-tapered portion 24B, and the thickness of the insulating layer 14 both are about 8 μm. Since the thickness of the insulating layer 14 is large as described, a further reduction is achieved for the capacitance between the cathode electrode 12 and the gate electrode 16. Furthermore, since the thickness of the non-tapered portion 24B is large enough to reduce the current density of the electric current flowing in the emitter 24, the melting of the emitter 24 is further suppressed.

The radius of curvature at the tip of the emitter 24 is not more than 20 nm. Since the radius of curvature at the tip of the emitter 24 is not more than 100 nm as described, the electric field is concentrated there to increase the emission efficiency of electrons emitted from the emitter. Furthermore, the emitters 24 were arranged at intervals of 3 μm and the density of emitters 24 on the surface of the cathode electrode 12 was about 11,110,000 emitters/$cm^2$. Since the cold-cathode electron source 10 has the high density of emitters 24 as described, a lot of electrons are emitted from the cathode electrode 12. Since the emitters 24 are arranged so as not to contact the insulating layer 14 and the gate electrode 16 inside the electron emission holes 20, the emitters are substantially prevented from short-circuiting.

A method of producing the cold-cathode electron source described above will be described below with reference to FIGS. 3A to 3E.

First, a diamond plate 30 as a base of a cathode substrate is prepared by a vapor phase synthesis method based on hot filament CVD or microwave CVD, or by a high pressure synthesis method. Then this diamond plate 30 is etched by RIE using a mixed gas of $CF_4$ and oxygen, to form emitters 24 in the aforementioned shape (cf. FIG. 3A). The method of forming the emitters is not limited to the RIE process, but may be any other method, e.g., ion beam etching.

Figures 3A, 3B, 3C, 3D, 3E:
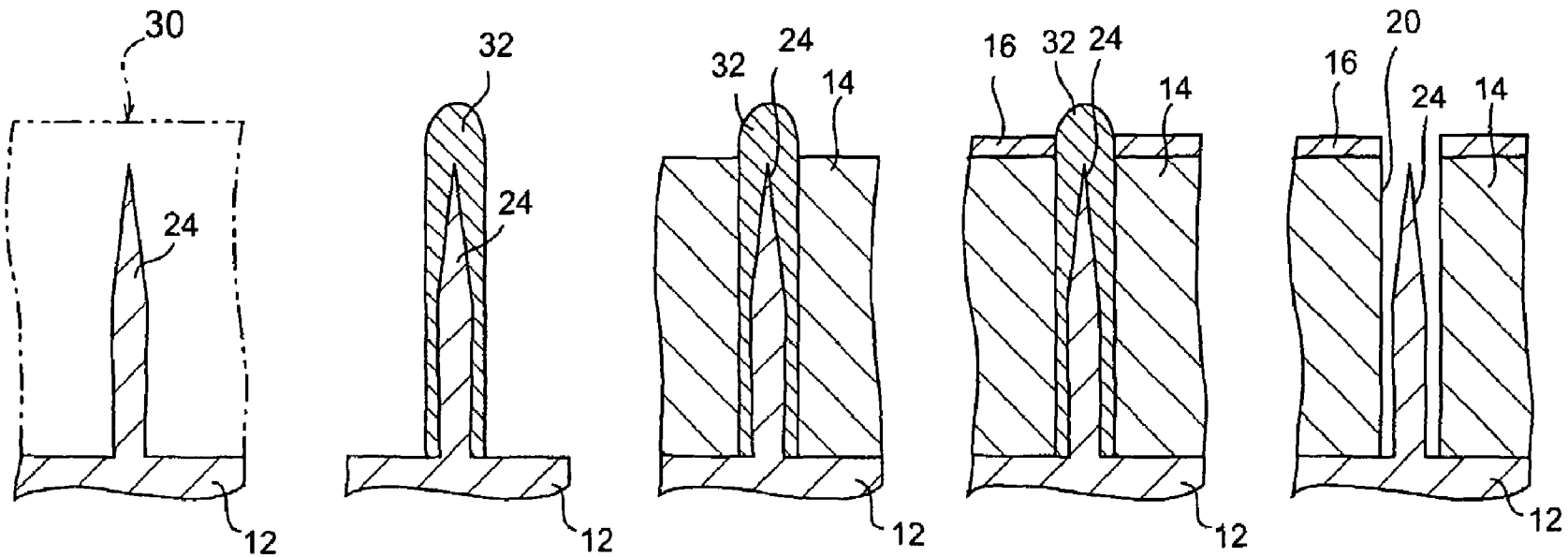
FIG. 3A is an illustration showing a production procedure of the cold-cathode electron source of FIG. 1.
FIG. 3B is an illustration showing the production procedure of the cold-cathode electron source of FIG. 1.
FIG. 3C is an illustration showing the production procedure of the cold-cathode electron source of FIG. 1.
FIG. 3D is an illustration showing the production procedure of the cold-cathode electron source of FIG. 1.
FIG. 3E is an illustration showing the production procedure of the cold-cathode electron source of FIG. 1.
Figures 4A, 4B, 4C, 4D, 4E:
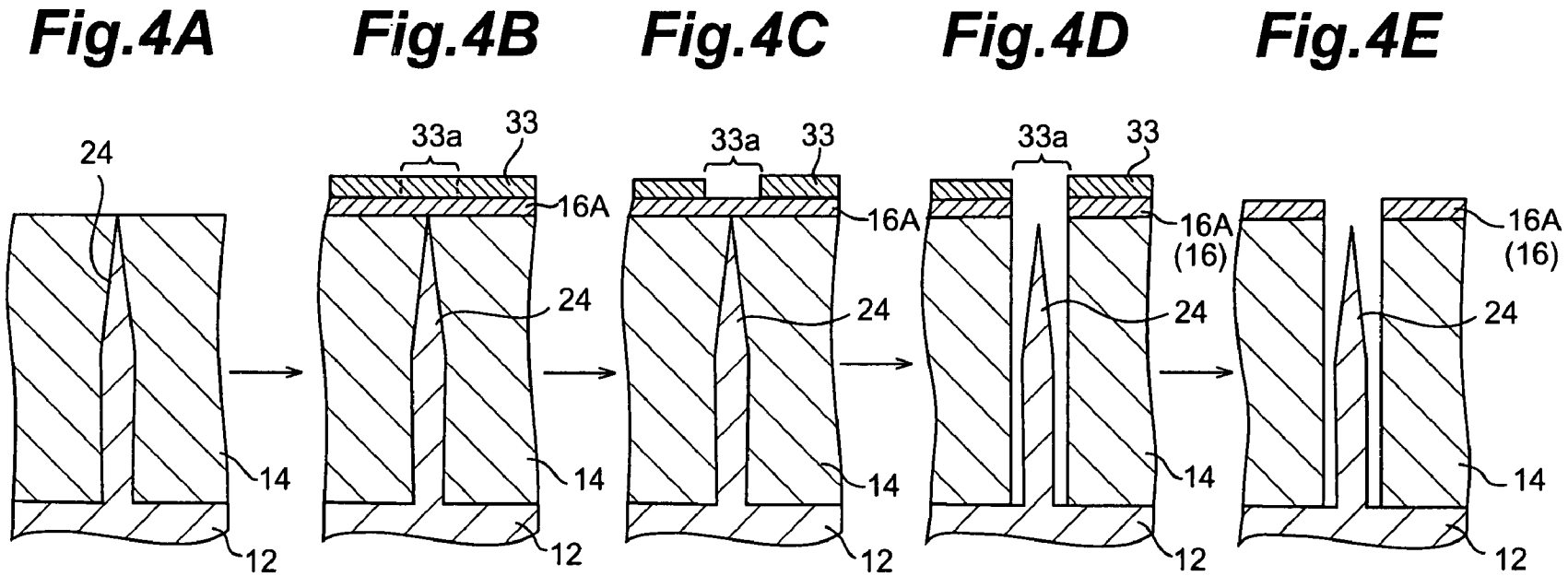
FIG. 4A is an illustration showing another production procedure of the cold-cathode electron source of FIG. 1.
FIG. 4B is an illustration showing the production procedure of the cold-cathode electron source of FIG. 1.
FIG. 4C is an illustration showing the production procedure of the cold-cathode electron source of FIG. 1.
FIG. 4D is an illustration showing the production procedure of the cold-cathode electron source of FIG. 1.
FIG. 4E is an illustration showing the production procedure of the cold-cathode electron source of FIG. 1.
Figure 5:
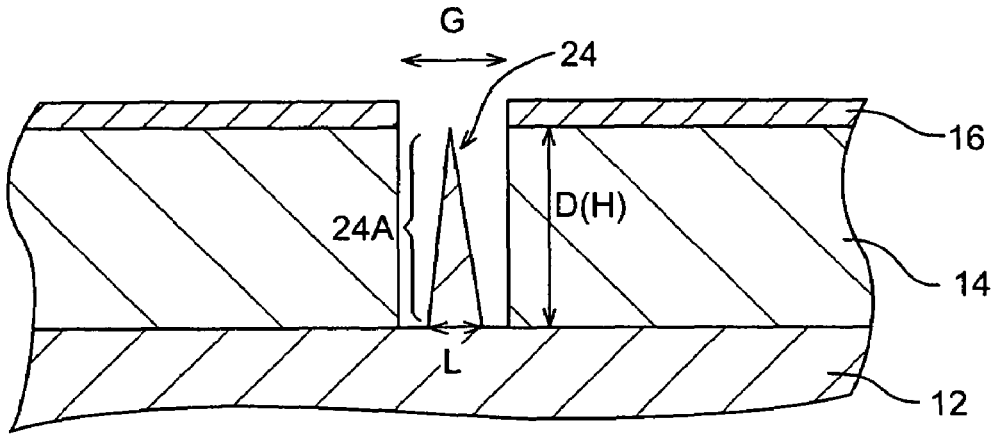
FIG. 5 is an illustration showing an example of emitter shape.

Then the surfaces of emitters 24 are coated with $SiO_2$ film (coating) 32 by sputtering (cf. FIG. 3B). In this state, an insulating diamond is deposited on the surface of the cathode electrode 12 by hot filament CVD to form an insulating layer 14 lower than the height of the emitters 24 coated with the $SiO_2$ film 32 (cf. FIG. 3C). After the insulating layer 14 is laid on the cathode electrode 12, a conductive diamond is deposited in a thickness not to bury the emitters 24 coated with the $SiO_2$ film 32, on this insulating layer 14 by hot filament CVD to form the gate electrode 16 (cf. FIG. 3D). Then the $SiO_2$ film 32 covering the emitters 24 is finally removed by etching with hydrofluoric acid, thereby completing the production of the cold-cathode electron source 10 (cf. FIG. 3E). The thicknesses of the insulating layer 14 and the gate electrode 16 may be optionally changed.

By adopting this production method, it is feasible to form the insulating layer 14 and the gate electrode 16 even with relatively low position accuracy as compared with the conventional production methods using photolithography. A production method of a cold-cathode electron source using photolithography will be described below for reference. FIGS. 4A to 4E are illustrations showing the production method of the cold-cathode electron source using photolithography. In this method, the insulating layer 14 is first deposited over the entire cathode electrode 12 so that the emitters 24 are buried (cf. FIG. 4A). Then a metal film 16A to become the gate electrode 16 is deposited on the insulating layer 14 and a photoresist 33 is deposited further thereon (cf. FIG. 4B). After this photoresist 33 is deposited, the portions other than the emitter regions 33*a* are exposed and developed, and the photoresist 33 is removed from the emitter regions 33*a* (cf. FIG. 4C). Then the metal film 16*a* and the insulating layer 14 in the emitter regions 33*a* are removed by etching with an appropriate etchant or etching gas (cf. FIG. 4D). Finally, the photoresist 33 is removed, thereby completing the production of the cold-cathode electron source 10 (cf. FIG. 4E).

However, the production by this method is difficult unless the gate electrode 16 and insulating layer 14 are made of materials different from the diamond of the cathode electrode 12 as described above. Particularly, in a case where a diamond is used for the insulating layer 14, since the etch selectivity of the diamond insulating layer 14 and the diamond emitters 24 different only in their dopant is low, it is difficult to obtain sharp emitters 24. In addition, the production method of the cold-cathode electron source 10 using photolithography requires locating of the emitter regions 33*a* and thus an advanced locating technology of sub μm or less order is demanded. Such high-accurate locating needs an expensive exposure system and productivity is very low. On the other hand, in the production method shown in FIGS. 3A-3E, the emitters 24 are covered with the $SiO_2$ film of the approximately uniform thickness, and there is no need for high-accurate locating and registration. By the production method using the $SiO_2$ film, therefore, the insulating layer 14 and the gate electrode 16 can be deposited around the emitters 24 by a relatively simple method. When the diamond insulating layer 14 is homoepitaxially grown on the cathode electrode 12 of diamond, the structure becomes denser than the insulating layers of the conventional materials, to improve the breakdown strength of the insulating layer due to a high voltage. The coating film covering the emitters 24 is not limited to the $SiO_2$ film, but may be an oxide film such as $Al_2O_3$ film, for example.

As detailed above, the cold-cathode electron source 10 has the emitters 24 of the diamond having the aspect ratio R of 4, so as to achieve a high output and the capacitance between the cathode electrode 12 and the gate electrode 16 is reduced so as to achieve a high frequency.

Figure 6:
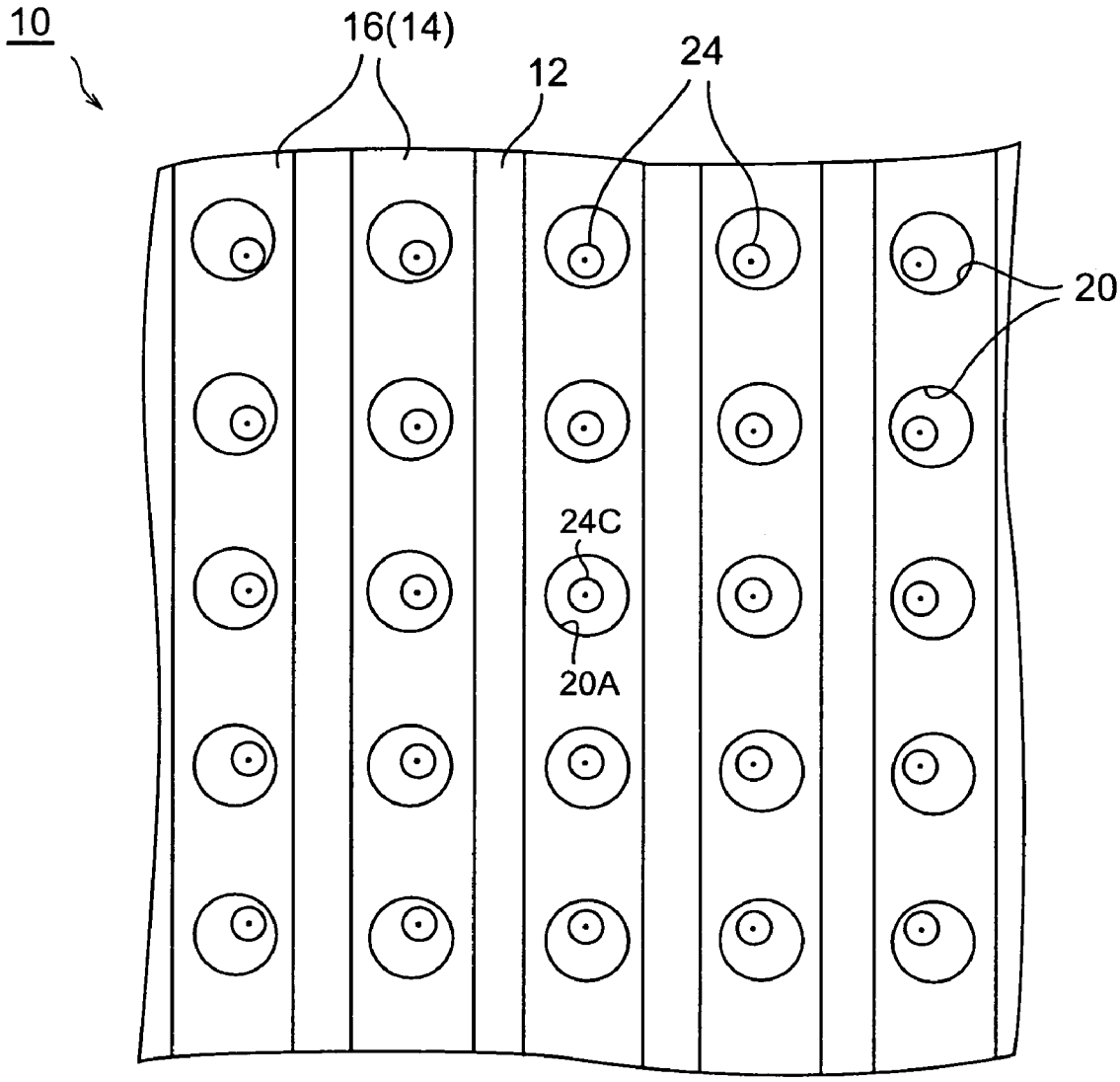
FIG. 6 is an illustration showing an example of arrangement of electron emission holes.

The shape of emitters 24 does not have to be limited to the above-described shape, but, where the thickness of the insulating layer 14 is not so large, the emitters may be formed in an emitter shape without the non-tapered portion. The positional relation of the electron emission holes does not have to be limited to the above-described matrix array, but may be a point symmetry array as shown in FIG. 6. Specifically, an emitter 24 distant from a certain specific point (a center of an emitter 24C) on the cathode electrode deviates relative to a corresponding electron emission hole 20 by a degree according to the distance from the specific point. This deviation is made in such a direction that the relative position of the corresponding electron emission hole 20 to the emitter 24 becomes more distant from the specific point with distance of the emitter 24 from the specific point. In this arrangement of the electron emission holes 20 in the gate electrode 16, when a positive voltage is applied to the gate electrode 16, electrons emitted from each emitter 24 are largely affected by the electric field at the edge of the gate electrode 16 near the emitter 24 and the emission direction is curved toward the edge. For this reason, electrons emitted out of the electron emission holes 20 are focused toward the aforementioned specific point (electrostatic lens effect) to increase the current density of the electric current obtained from the cold-cathode electron source 10. In the case where the emitters 24 are not located at the center positions of the electron emission holes 20, the production method using photolithography (cf. FIGS. 4A-4E) is used instead of the production method using the aforementioned coating film (cf. FIGS. 3A-3E).

Figure 7:
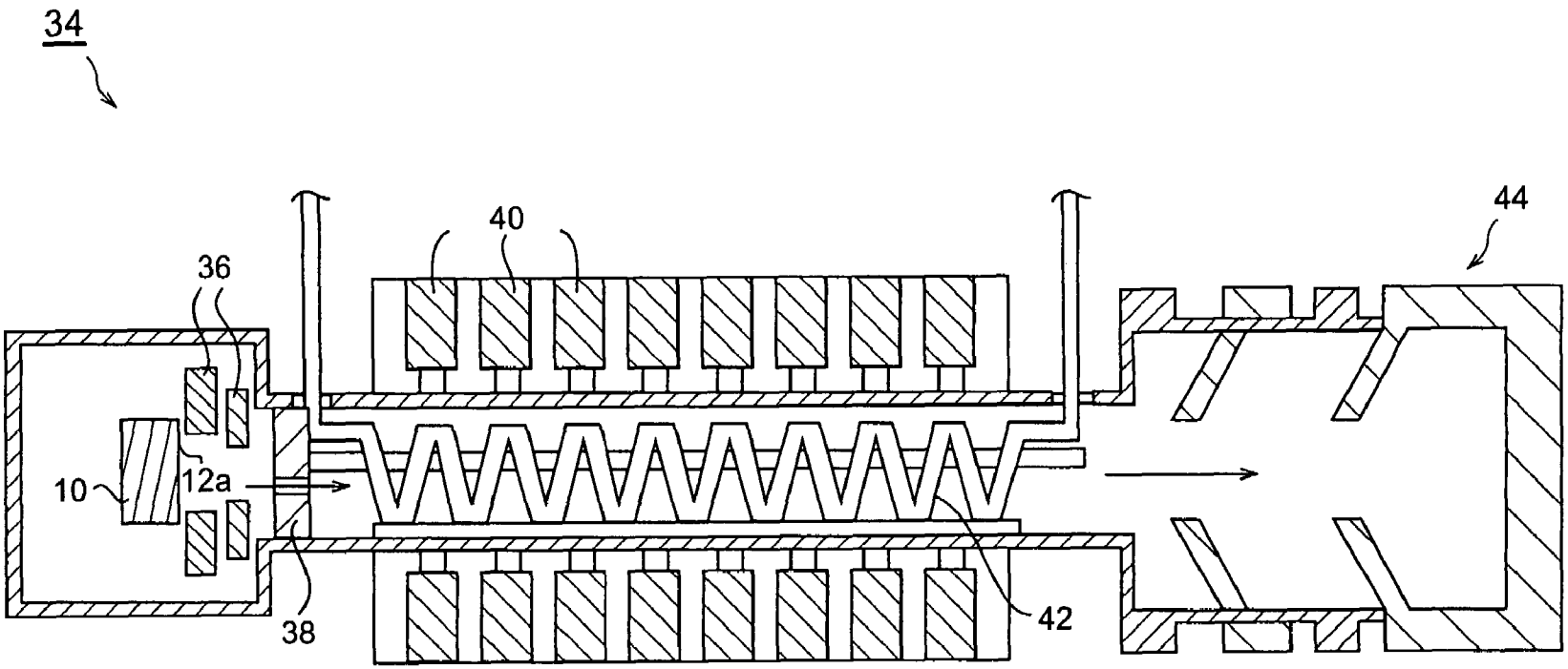
FIG. 7 is a schematic sectional view showing a microwave tube according to an embodiment of the present invention.

Subsequently, a microwave tube (traveling-wave tube) using the aforementioned cold-cathode electron source 10 will be described with reference to FIG. 7. FIG. 7 is a schematic configuration diagram showing a microwave tube 34 using the cold-cathode electron source 10.

In this microwave tube 34, electrons emitted from a surface 12*a* of the cathode electrode 12 of the cold-cathode electron source 10 are focused by an electric field established by a Wehnelt electrode 36, an anode 38, and the cold-cathode electron source 10, and the diameter thereof decreases with distance from the cold-cathode electron source 10. Then the electrons pass through a center hole of the anode 38. An electron stream (electron beam) formed in this manner is affected by magnetic field lines created by magnets 40 and passes an interior of spiral 42 while being focused into a fixed beam diameter, to reach a collector 44. On the way of passage through the spiral 42, an input electromagnetic wave and the electron beam traveling along the spiral 42 interact with each other to convert the dc energy in the electron beam to energy of the electromagnetic wave to amplify it. At this time, an amplified signal with excellent S/N ratios can be obtained by modifying the electron beam by a high-frequency wave.

When the cold-cathode electron source 10 is applied to the microwave tube 34 of this type, it is feasible to achieve an improvement in the frequency and output of the microwave tube, because the cold-cathode electron source 10 is able to support the operation at a high frequency and a high output as described above. For example, in the case of the conventional traveling-wave tubes, the maximum frequency was about 100 GHz for output of kW level, and in the case of gyrotrons, the maximum frequency was about 300 GHz for the output of kW level. In a case where the aspect ratio of the emitters of the cold-cathode electron source 10 is set to 4 or more so as to reduce the capacitance to approximately a quarter, a power loss can be reduced to the conventional level even if the modulation frequency of the electron beam is four times higher than the conventional level. Therefore, the frequency and output of the microwave tube 34 can be increased up to the high frequency as high as 400 GHz, which was hardly achieved even by the conventional gyrotrons, and up to a high output region corresponding to the frequency.

The present invention is not limited to the above embodiments, but can involve various modifications. For example, the aspect ratio R of emitters 24 does not have to be limited to 4, but may be any value larger than 4. When the emitters having such an aspect ratio are formed, the cold-cathode electron source is able to achieve a much higher frequency. The cold-cathode electron source 10 can be applied to all electron emitting devices necessitating a high frequency and a high output, such as CRTs and electron sources for electron beam exposure, as well as the microwave tubes 34.

Next, examples of the aforementioned cold-cathode electron source and microwave tube will be described.

EXAMPLE 1

As an example, the cathode electrode and emitters were made of a conductive diamond. A method thereof will be described below.

First, a thin film of a diamond doped with boron was homoepitaxially grown on a (100)-oriented type Ib monocrystalline diamond by microwave plasma CVD. The film-forming conditions were as follows.

A flow rate and a composition of gases used for the synthesis of the diamond were as follows: the flow rate of hydrogen gas ($H_2$) was 100 sccm and the ratio of $CH_4$ and $H_2$ 6:100. A boron (atomic symbol: B) doping gas was diborane gas ($B_2H_6$). A flow ratio of this diborane gas and $CH_4$ gas was 167 ppm. The synthesis pressure at this time was 40 Torr. The frequency of the microwave used in this example was 2.45 GHz, the output 300 W, and the sample temperature during the diamond synthesis 830° C. The thin film after the synthesis was 30 μm thick.

Next, this diamond was etched to form emitters. A forming method thereof was as follows. First, a film of Al was deposited in the thickness of 0.5 μm by sputtering and dots were made in the diameter of 1.5 μm by photolithography. Then, using a capacitively coupled RF plasma etching system, etching was conducted under the conditions of the flow ratio of $CF_4$ and $O_2$ gas of 1:100, the gas pressure of 2 Pa, and the high frequency power of 200 W to form emitters. The emitters thus formed had the following shape: the width (L) of the bottom of the tapered portion was 0.9 μm, the height (D) about 8 μm, and the height (H) of the slope portion 4 μm. Namely, the aspect ratio R was 4.4. The intervals of the emitters were 3 μm, and the density thereof was approximately 11,110,000 emitters/$cm^2$.

EXAMPLE 2

As an example, a cold-cathode electron source applied to a microwave tube was fabricated. A method thereof will be described below.

First, a thin film of a phosphorus (atomic symbol: P)-doped diamond was formed on a (111)-oriented type Ib monocrystalline diamond substrate by microwave plasma CVD. The synthesis conditions were as follows: the flow rate of hydrogen gas was 400 sccm, and the ratio of $CH_4$ and $H_2$ 0.075:100. The doping gas was $PH_3$ (phosphine). The flow ratio of $PH_3$ and $CH_4$ was 1000 ppm. The synthesis pressure was 80 Torr, the microwave output 500 W, and the sample temperature during the synthesis 900° C. The thickness of the thin film thus synthesized was 10 μm.

Then this diamond was etched to form emitters. A forming method thereof was as follows. First, a film of Al was deposited in the thickness of 0.5 μm by sputtering and dots were formed in the diameter of 2.5 μm by photolithography. Then, using a capacitively coupled RF plasma etching system, etching was conducted under the conditions of the flow ratio of $CF_4$ and $O_2$ of 1:100, the gas pressure of 25 Pa, and the high frequency power of 200 W to form emitters. The emitters thus formed had the following shape: the width (L) of the base was 1.2 μm, and the height (D) of the emitters and the height (H) of the slope portion were about 5 μm. Namely, the side face of the emitters was inclined almost entirely from the tip to the base of the emitters, and the aspect ratio R was about 4.2.

Figure 8A:
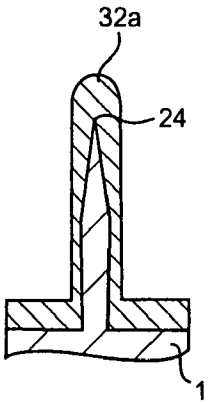
FIG. 8A is an illustration showing a different production procedure of a cold-cathode electron source.
Figure 8B:
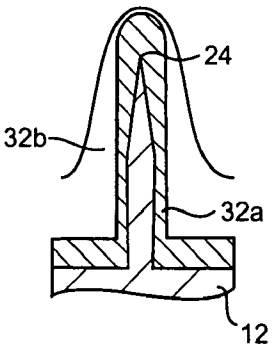
FIG. 8B is an illustration showing the different production procedure of the cold-cathode electron source.
Figure 8C:
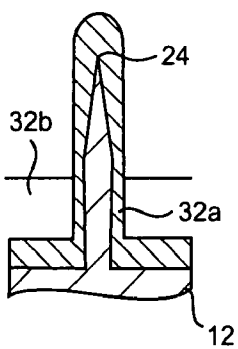
FIG. 8C is an illustration showing the different production procedure of the cold-cathode electron source.
Figure 8D:
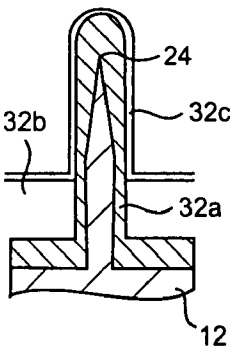
FIG. 8D is an illustration showing the different production procedure of the cold-cathode electron source.
Figure 8G:
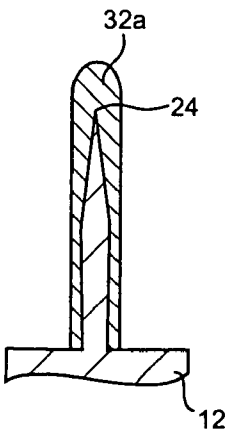
FIG. 8G is an illustration showing the different production procedure of the cold-cathode electron source.
Figure 8F:
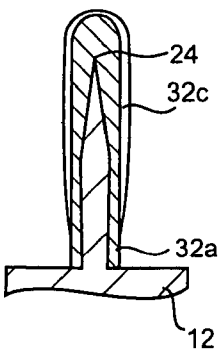
FIG. 8F is an illustration showing the different production procedure of the cold-cathode electron source.
Figure 8E:
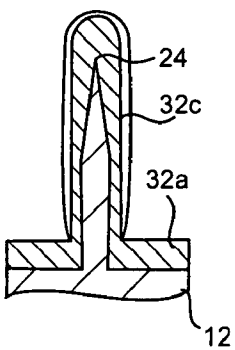
FIG. 8E is an illustration showing the different production procedure of the cold-cathode electron source.
Figure 9:
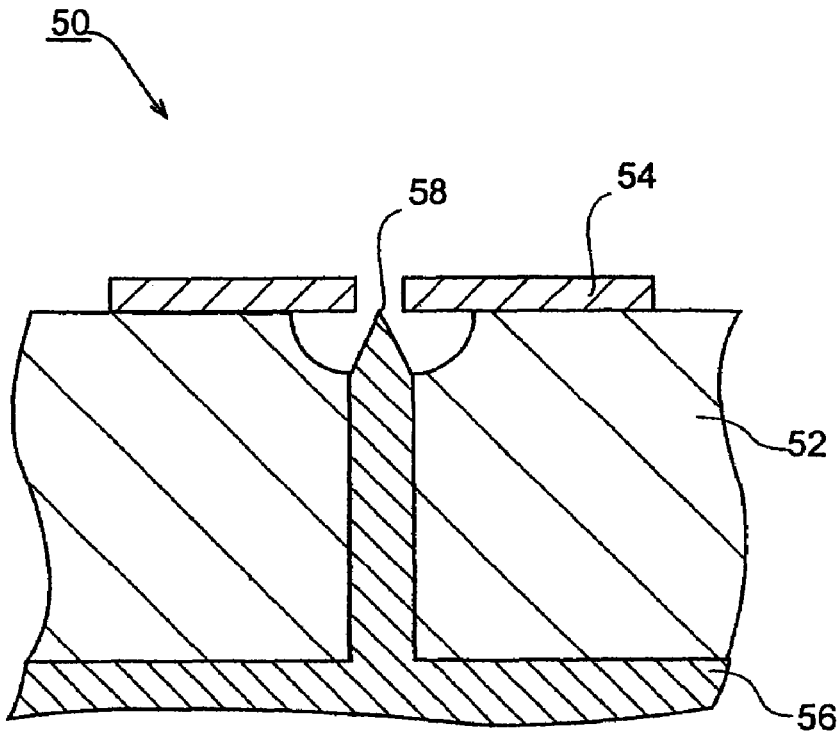
Fig.9 PRIOR ART
FIG. 9 is an illustration showing an example of the conventional cold-cathode electron source.
Figure 10:
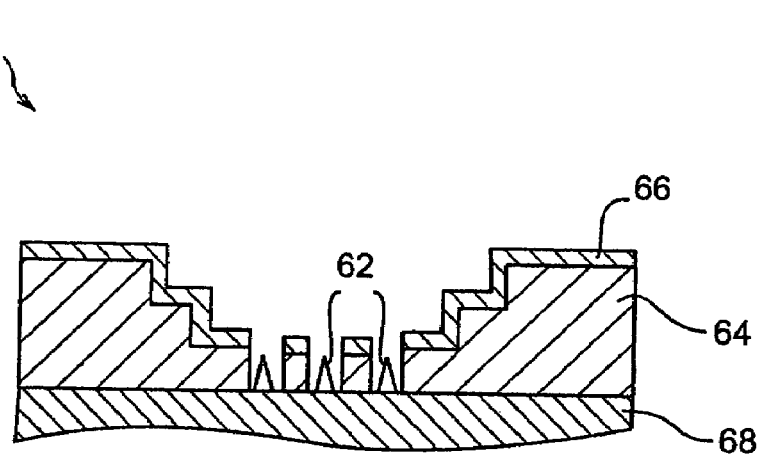
Fig.10 PRIOR ART
FIG. 10 is an illustration showing an example of the conventional cold-cathode electron source.

Then, an $SiO_2$ film was deposited only over the surfaces of emitters by sputtering, prior to formation of the insulating layer. The procedure of this film-forming process will be described below in detail with reference to FIGS. 8A-8G. First, the surfaces of emitters 24 are coated with an $SiO_2$ film (coating) 32*a* (cf. FIG. 8A). A resist 32*b* is applied over the film (cf. FIG. 8B), and thereafter the resist 32*b* is etched with an oxygen plasma to expose the top part of $SiO_2$ 32*a* (cf. FIG. 8C). An Mo resist 32*c* is deposited thereon by sputtering (cf. FIG. 8E). This is ultrasonic cleaned with acetone to remove the Mo resist 32*c* while leaving the Mo resist 32*c* only around the projections (cf. FIG. 8F). This is etched with hydrofluoric acid, whereupon $SiO_2$ 32*a* remains only around the projections with Mo insoluble in hydrofluoric acid serving as a mask. This is etched with aqua regia, whereupon emitters 24 turn into a state in which they are covered by $SiO_2$ 32*a* only (cf. FIG. 3G). In this state, a diamond for the insulating layer is deposited in a microwave plasma CVD reactor, whereby the insulating diamond is formed in the portions other than the emitters, with the $SiO_2$ films serving as a mask. The film-forming conditions are the same as in Example 1 described above, except that the diborane gas is not used. The thickness of the insulating diamond (insulating layer) was 4.8 μm.

Furthermore, a boron-doped diamond was deposited in the thickness of 0.2 μm to form the gate electrode. The diameter (G) of the electron emission holes in the gate electrode was about 1 μm.

Films of Ti/Pt/Au were deposited on the conductive diamond formed as described above, to form an electrode for control, and the electron source thus formed was mounted as the electron source 10 on the microwave tube 34 shown in FIG. 7. The electron source 10 stably provided the electron beam of 150 A/cm$^2$ in continuous operation. The electron beam interacted with an input signal during passage through the spiral (slow wave circuit) 42 to output an amplified signal.

What is claimed is:

1. A cold-cathode electron source, comprising:

a flat-plate cathode electrode comprising a diamond and having a plurality of microscopic projecting emitters on a surface;

an insulating layer laid around each emitter on the surface of the cathode electrode; and a gate electrode laid on the insulating layer, wherein the cold-cathode electron source being configured to adjust an amount of electrons emitted from the emitters of the cathode electrode to the outside, by controlling a voltage applied to the gate electrode, the emitters have a base portion of cylindrical shape and a tapered tip portion of substantially cylindrical shape and an aspect ratio R defined below is not less than 4: R=H/L, where H is a height of the tapered portion and L a diameter of the base portion, the insulating layer and the gate electrode have electron emission holes having a diameter larger than a diameter of the emitters, each emitter is disposed inside the electron emission hole so as not to contact the insulating layer and the gate electrode, the plurality of emitters are formed on the cathode electrode, having a distance for the plurality of the emitters from a specific point on the cathode electrode, a relative position of each emitter to the corresponding electron emission hole increases its deviation amount from the specific point, a density of the emitters on the surface of the cathode electrode is not less than $10^7$ emitters/cm$^2$, and height of the tapered tip portion of the emitters is not less than 4 μm.

2. A microwave tube comprising the cold-cathode electron source as set forth in claim 1.

3. A cold-cathode electron source, comprising:

a flat-plate cathode electrode comprising a diamond and having a plurality of microscopic projecting emitters on a surface;

an insulating layer laid around each emitter on the surface of the cathode electrode; and a gate electrode laid on the insulating layer, wherein the cold-cathode electron source being configured to adjust an amount of electrons emitted from the emitters of the cathode electrode to the outside, by controlling a voltage applied to the gate electrode, the emitters have a base portion of cylindrical shape and a tapered tip portion of substantially cylindrical shape and an aspect ratio R, where R=H/L, where H is a height of the tapered portion, L is a diameter of the base portion, and R is not less than 4, the insulating layer and the gate electrode have electron emission holes having a diameter larger than a diameter of the emitters, each emitter is disposed inside the electron emission hole so as not to contact the insulating layer and the gate electrode, and a density of the emitters on the surface of the cathode electrode is not less than $10^7$ emitters/cm$^2$.

* * * * *